United States Patent [19]

Kunz

[11] 4,376,009

[45] Mar. 8, 1983

[54] LIMP-STREAM METHOD FOR SELECTIVELY ETCHING INTEGRAL CATHODE SUBSTRATE AND SUPPORT

[75] Inventor: Peter J. Kunz, East Petersburg, Pa.

[73] Assignee: RCA Corporation, New York, N.Y.

[21] Appl. No.: 373,052

[22] Filed: Apr. 29, 1982

[51] Int. Cl.[3] ..... C23F 1/02

[52] U.S. Cl. ..... 156/640; 156/345; 156/642; 156/656

[58] Field of Search ..... 156/637, 639, 640, 642, 156/651, 652, 656, 659.1, 345, 641

[56] References Cited

U.S. PATENT DOCUMENTS

| | | | |
|---|---|---|---|
| 2,905,539 | 9/1959 | Bowerman | 156/345 X |
| 3,432,900 | 3/1969 | Kerstetter | 29/25.17 |
| 3,510,372 | 5/1970 | Hoornstra | 156/345 X |
| 3,861,981 | 1/1975 | Loo | 156/644 X |
| 3,986,911 | 10/1976 | Lerner | 156/345 X |
| 4,021,279 | 5/1977 | Hirs | 156/345 X |

OTHER PUBLICATIONS

RCA Technical Notes, TN No. 1159, mailed Jul. 23, 1976, One-Piece Bimetal Cathode Cup and Sleeve by J. C. Turnbull.

U.S. Patent Application Serial No. 210,246 filed Nov. 25, 1980 by W. R. Poff et al., currently pending.

*Primary Examiner*—William A. Powell

*Attorney, Agent, or Firm*—E. M. Whitacre; D. H. Irlbeck; L. Greenspan

[57] ABSTRACT

In a method for preparing an integral cathode substrate and support in which selected surface portions of a formed metal part are masked, the unmasked surface portions etched, and then the mask removed, the improvement wherein the etching step is conducted by alternately directing a solid limp stream of liquid etchant into and out of contact with the part while permitting the liquid etchant to drain away from the part by gravity.

10 Claims, 5 Drawing Figures

83
82
89
81
40
71
65
73
75
31
67
65
31
81
67
65
40
91
93
79
85
P
87
V
83

LIMP-STREAM METHOD FOR SELECTIVELY ETCHING INTEGRAL CATHODE SUBSTRATE AND SUPPORT

BACKGROUND OF THE INVENTION

This invention relates to a novel method for selectively etching an integral or unitary cathode substrate and support; and particularly, although not exclusively, to an improved method for selectively etching a cylindrical one-piece bimetal cathode substrate and support sleeve.

A one-piece bimetal cathode substrate and support sleeve is disclosed by J. C. Turnbull in RCA Technical Notes TN No. 1159 mailed July 23, 1976. The one-piece part is described generally as a cup-shaped nickel-alloy cathode substrate integrally supported on a thin cylinder and endwall of a structural alloy such as a nickel-chromium alloy. The part is fabricated from a bimetal laminate comprised of layers of the two alloys which are clad or otherwise joined together.

That one-piece bimetal part has been fabricated by the general method disclosed in U.S. Pat. No. 3,432,900 issued Mar. 18, 1969 to D. R. Kerstetter. By this method, a cup-and-sleeve is deep drawn from a bimetal laminate strip. Then, selected portions of the nickel-alloy layer are masked with a temporary coating of an etch-resistant material and then the unmasked portions are etched away with a liquid etchant. In an alternative method disclosed in U.S. patent application Ser. No. 210,246 filed Nov. 25, 1980 by W. R. Poff et al., selected portions of the nickel-alloy layer are selectively masked by temporarily pressing surface portions of an etch-resistant, compressible sheet, such as a silicone rubber sheet, against selected surface portions of the part. In both of the prior methods, the unmasked portions of the nickel-alloy layer are etched away either by immersing the part in a bath of liquid etchant or by pumping the liquid etchant into contact with the part.

In a mass-production form of the Poff et al. method, a plurality of cylindrical parts is mounted on separate mandrels with all of the endwalls in a plane, and the endwalls pressed into a common compressible sheet. The sheet constitutes one wall of a common chamber housing all of the parts. With the chamber filled with liquid etchant, etchant is pumped into, through and out of the chamber. Attempts to mass produce parts by the Poff et al. method, by shortening the etching time and increasing the number of parts in the chamber, were marred by the formation of blemishes and other defects on the etched parts. These defects were believed to be caused by tiny bubbles in the chamber which blocked or retarded the etching in local areas on the surface of the parts. Various attempts to overcome the problem, as by increasing the flow rate of etchant through the chamber or by channeling the flow of etchant in the chamber, reduced the prevalence of some defects but increased the prevalence of other defects.

SUMMARY OF THE INVENTION

In the novel method, the etching step is conducted by alternately directing a solid limp stream of liquid etchant into and out of contact with the part being etched while permitting the etchant to drain away from the part by gravity. In so doing, gases which are entrained in the etchant or are generated by the etching process can escape during the etching step. Furthermore, the movement of the stream relative to the part not only applies fresh etchant for the etching process but also forces out gases which may be present around the part. It has been found that the etching process is completed in less time and with lower flow rates with the novel method than with the prior Poff et al. method.

DETAILED DESCRIPTION OF THE PREFERRED EMBODIMENTS

In this document, "limp stream" means a stream of liquid whose direction is determined principally by the force of gravity, and "downwardly" means in the direction of the force of gravity.

Figure 1:
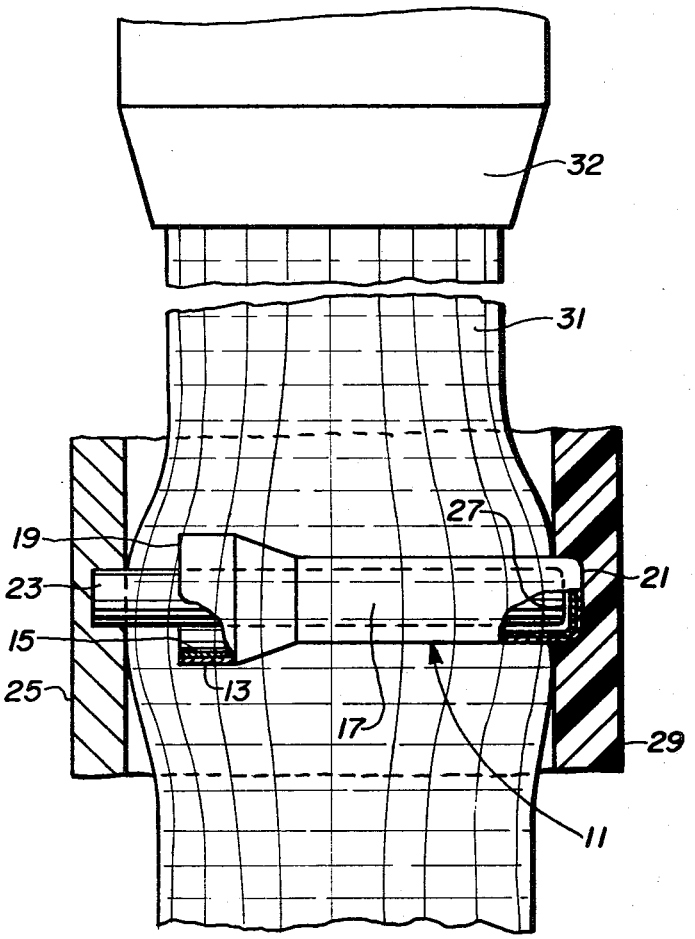
FIG. 1 is a fragmentary partially-sectional elevational view of a formed bimetal part being etched by a first embodiment of the novel method.

FIG. 1 shows a typical formed bimetal part or blank 11 being etched according to a first embodiment of the novel method. The blank 11 is deep-drawn from a bimetal strip so as to provide a cup-shaped structure with a cathode-substrate nickel-alloy layer 13 on the outside and a structural nickel-chromium alloy layer 15 on the inside. A typical cathode-substrate alloy consists essentially of at least 94.90-weight-percent nickel and up to about 0.05-weight-percent silicon and magnesium. The part 11 is comprised of a cylindrical sleeve 17 about 2.16 mm (85 mils) at its narrowest outside diameter and about 8.76 mm (345 mils) in overall height. The sleeve 17 flares out and is open at one end 19 and is closed by an endwall 21 at the other end. The cathode-substrate alloy layer 13 is about 0.028 mm (1.1 mils) thick and the structural alloy layer 15 is about 0.048 mm (1.9 mils) thick. The cathode-substrate alloy layer 13 is much more soluble in certain etchants than the inner layer 15, particularly in relatively dilute acids. This differential is exploited in the novel method. In preferred forms of the novel method, the outer layer 13 is soluble and the inner layer 15 is substantially insoluble in the etchant.

By the first embodiment of the novel method, the formed cup-shaped part 11 is placed on an upstanding cylindrical mandrel 23 which is supported on a base plate 25. The inner surface of the endwall 21 is in contact with the upper end surface 27 of the mandrel 23. Preferably, the contacting surfaces should substantially mate with one another. A sheet 29 of compressible etch-resistant material is pressed against the outer surface of the endwall such that the sheet 29 is compressed and presses against the adjacent portions of the sidewall thereby masking selected areas of the part 11. The greater the pressure, the greater the amount of sidewall 17 that is covered by the sheet 29. The assembly is now rotated to the position shown in FIG. 1 with the mandrel 23 horizontal and the space between the base plate 25 and the sheet 29 in a vertical position.

With the part 11 and the sheet 29 in this position, a solid limp stream of a liquid etchant, which in this embodiment is a 32-weight-percent solution of nitric acid at a temperature of about 80° C., is intermittently poured downwardly from a nozzle 32 through the space between the plate 25 and the sheet 29. The acid contacts with and dissolves the unmasked portions of the cathode-substrate layer 13. The etchant may also contact the structural alloy layer 15 but, since the structural alloy layer 15 is substantially insoluble in the etchant, substantially no dissolution takes place. As shown in FIG. 1, the etchant 31 floods the surfaces of the part 11 except where the surface is masked. The stream 31 can be applied intermittently by moving the nozzle 32 horizontally back and forth over and past the part 17. When the stream is not impinging on the part, acid in contact with the part 17 is draining by gravity, and gases generated by the chemical reaction escape to the ambient. When the stream 31 again impinges on the part 17, it replenishes the acid on the part 17 and also drives the gases away from the part 17. As a result, gases do not inhibit the reaction, and more uniform etching of the unmasked surfaces is obtained. These benefits are achieved with the use of far less acid than is required by prior methods of applying the acid to the part. Spraying liquid acid on the unmasked surfaces of the part does not produce as uniform etching and requires more acid than does the solid-stream method described here.

Figure 2:
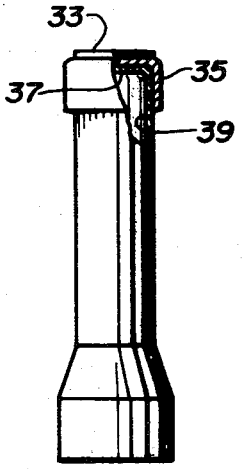
FIG. 2 is a partially broken-away elevational view of the completed etched bimetal part shown in FIG. 1 after the cathode coating has been applied to the cathode substrate thereof.

When the etching step is completed, the etchant 31 and the sheet 29 are removed. Then, the etched part 11 is removed from the mandrel 23, rinsed in deionized water in a vacuum flask to remove excess etchant and then dried at room temperature. Subsequently, a cathode coating is applied to the outer surface of the endwall 21, which was masked by the sheet 29. As shown in FIG. 2, a cathode coating 33 resides on a cap 35 of cathode-substrate nickel alloy, which is the unetched portion of the layer 13 of FIG. 1. This cap 35 is supported on the endwall 37 and sidewall 39 of the structural nickel-chromium alloy, which is substantially insoluble in the etchant used and is the unetched structural layer 15 of FIG. 1.

Figure 4:
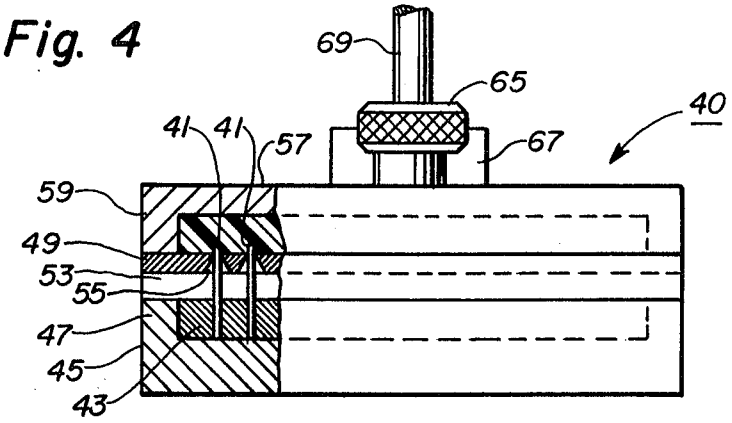
FIGS. 3 and 4 are partially-sectional front and side elevational views, respectively, of an apparatus for etching a batch of bimetal parts according to a second embodiment of the novel method.
Figure 3:
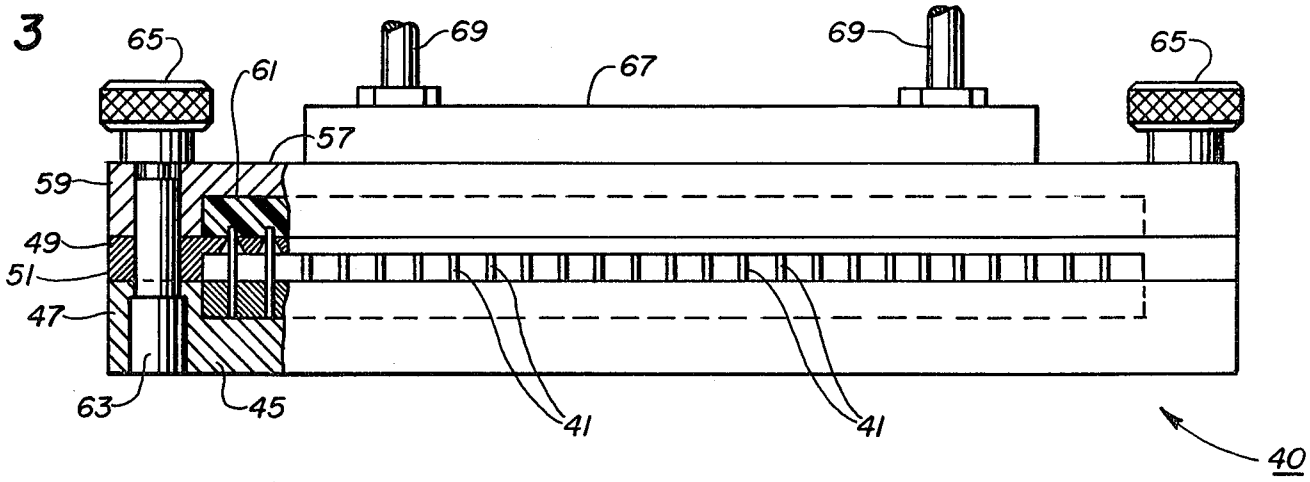

A second embodiment of the novel method may be practiced with the fixture 40 shown in FIGS. 3 and 4. This fixture 40 comprises an orthogonal array of pins or mandrels 41 set in spaced relation in a pin holder 43. There are twenty-five mandrels 41 spaced apart on about 250-mil centers in one direction, as shown in FIG. 3, and twelve mandrels spaced apart on about 250-mil centers in the other direction, as shown in FIG. 4. The pin holder 43 resides in a base 45 having an integral upwardly-extending peripheral sidewall 47. An apertured pressure plate 49 rests on the sidewall 47 of the base 45. The pressure plate 49 has two downward-extending sidewalls 51 on opposite sides thereof as shown in FIG. 3 which support the pressure plate 49 on the sidewall 47 of the base 45. The other two sides of the pressure plate 49 are open, thereby defining a slot or chamber open at each end indicated by the numeral 53 in FIG. 4. There is a plurality of apertures 55 through the pressure plate 49 through which the pins 41 extend. Each aperture 55 is about 0.76 mm (30 mils) larger in diameter than the outside diameter of the part to be etched. Also each aperture 55 is countersunk on the side of the pressure plate 49 facing the pin holder 43.

A backing plate 57 having a downwardly-extending peripheral sidewall 59 covers the apparatus, with the sidewall 59 thereof resting on the periphery of the pressure plate 49. A compressible sheet 61 of silicone rubber resides in the space within the sidewall 59 of the backing plate 57. The compressible sheet 61 may be a solid rubber or a plastic which is substantially insoluble and nonreactive with the etchant that is used in the novel method. The sheet 61 has a substantially-uniform thickness and is thicker than the height of the sidewall 59 of the backing plate 57 so that the sheet 57 is compressed when the backing plate 57 rests on the spacer plate 49. The pins 41 are of such length that they extend through the apertures 55 into the sheet 61 further compressing the sheet 61. Two locating bolts 63 and locking nuts 65 hold the above-described assembly together through registered apertures in each of the plates on opposite sides of the assembly. A stiffener 67 is welded to the top of the backing plate 57. Two rods 69 with handles (not shown) at the ends thereof are attached to the stiffener.

To practice the second embodiment of the novel method, blanks or parts 71 are positioned over the pins 41 substantially as described in FIG. 1. The pin holder 43 next is positioned in the base 45. Then, the pressure plate 49 is positioned over the base 45 with the pins 41 and the parts extending through the apertures 55. Now, a compressible sheet 61 of silicone rubber is positioned in the backing plate 57, and that combination is positioned on the pressure plate 49. The two locating bolts 63 are positioned in the registered apertures in each of the above-mentioned plates. Then, the locking nuts 65 are screwed down on the bolts 63 thereby urging the backing plate 57 towards the pressure plate 49. The compressible sheet 61 is squeezed against the endwalls of the parts and also against adjacent portions of the sidewalls of the parts, thereby masking selected surface portions of the parts.

Figure 5:
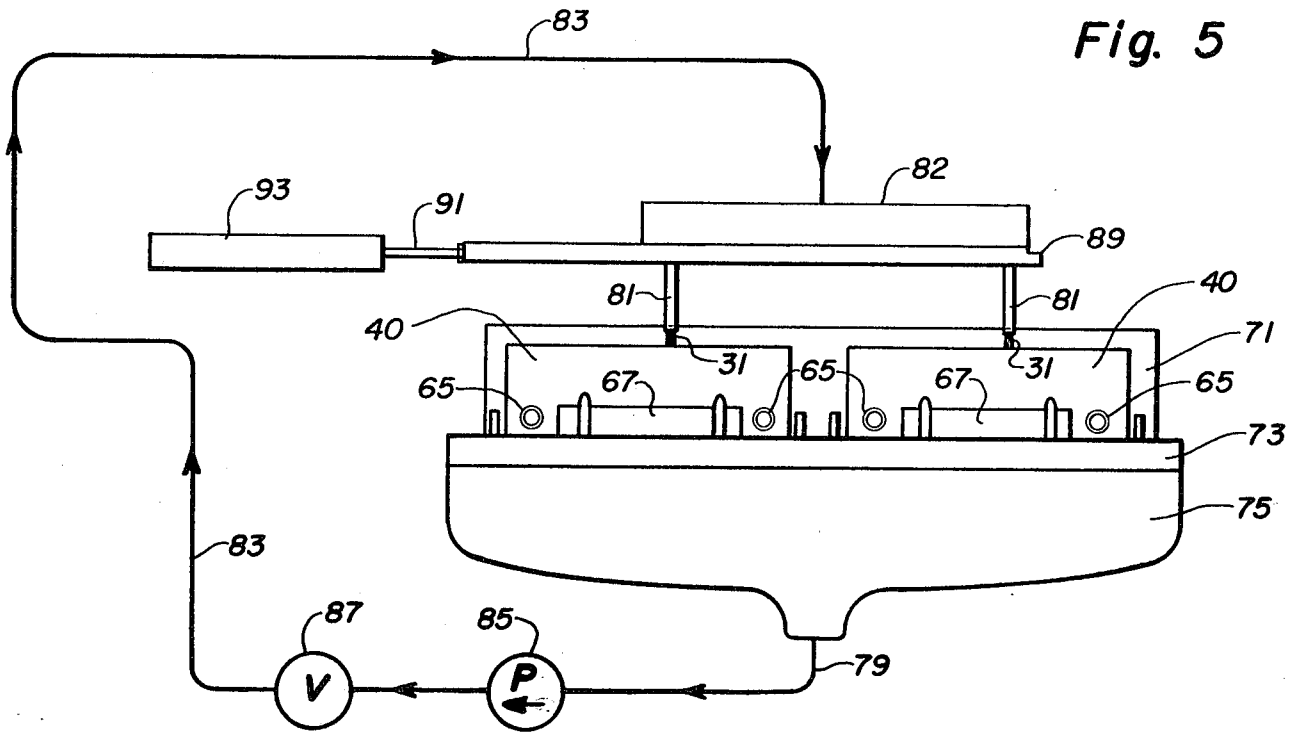
FIG. 5 is a partially schematic sectional elevational view of an apparatus in which parts are being etched in each of two fixtures shown in FIGS. 3 and 4.

Two fixtures 40, loaded with blank parts as described above, are loaded into a stationary fixture stand 71 shown in FIG. 5. The stand 71 is supported from a table 73 and fits into a basin 75 which also is supported from the table 73. The basin 75 includes a central drain 79 connected to a distributor tank 82 through flexible plastic piping 83, a pump 85 and a valve 87. The distributor tank 82 stores a relatively small amount of etchant during etching, and has two nozzles 81 in its bottom wall, from which the etchant can issue by gravity in two solid limp streams 31, one for each fixture 40. The distributor tank 82 and nozzles 81 are mounted above the fixtures 40 on a reciprocating arm 89 which is connected to the piston rod 91 of a pneumatic cylinder 93. To operate the apparatus, etchant is poured into the basin 75, the pump 85 is operated continuously and the valve 87 is adjusted so that each nozzle 81 delivers about 1.0 gpm (gallon per minute) in each solid limp stream 31. The pneumatic cylinder 93 is activated to move the bar 81 horizontally somewhat less than the length of each fixture in about 5.5 seconds (but can be in the range of 6 to 30 seconds). The nozzles pass over and deliver etchant into the slots 53 in each of the fixtures 40. The etchant drains out of the fixtures into the basin 75 from which it is recirculated back to the nozzles 81 until the etching step is completed.

In a preferred form of the second embodiment of the novel method, initially, the etching solution consists essentially of 45 weight parts of a 71-weight-percent solution of nitric acid, 10 weight parts of an 85-weight-percent phosphoric acid solution, 5 weight parts concentrated sulfuric acid (S.G. 1.2158) and 40 weight parts of deionized water. The etching solution is maintained at a temperature of about 80° C.±5° C. throughout the etching step. The etching step is conducted for about 6 minutes (but can be in the range of 2 to 6 minutes) at this temperature whereby the nozzles make 66 passes (33 cycles) over the fixtures 40. Complete etching leaves a dull metallic finish on the etched portions of the parts. Incomplete etching can be recognized by the presence of shiny areas where the dull metallic finish should appear. After the etching step is completed, the fixtures 40 are removed from the stand 71, and deionized water at 60° C.±5° C. is run through them for about 5 minutes. Then, after the fixtures 40 are disassembled, the etched parts are removed from the pins and placed in an overflow rinse container, where the cathode substrates are rinsed in deionized water at a temperature of about 60° C.±5° C. flowing at a rate of about 3 gpm (gallons per minute) for about 5 minutes.

The compressible silicone rubber sheet 61 can be replaced with a sheet of another compressible solid material that is resistant to chemical attack by the etchant. The preferred material is a room-temperature vulcanizing (RTV) silicone rubber. A compressible silicone rubber sheet may be prepared by casting a mixture of about 54-weight-percent liquid silicone elastomer (such as Sylgard 186 marketed by Dow-Corning, Midland, Mich.), 6% catalyst for the elastomer, and 40% liquid viscosity reducer (such as Silicone Rubber Diluent 910 marketed by General Electric Co., Waterford, N.Y.). The casting is permitted to cure overnight at about room temperature. Decreasing the content of viscosity reducer makes the silicone rubber product stiffer and less compressible, while increasing the content of viscosity reducer makes the product softer and more compresible.

In the prior etch method described in Poff et al., op. cit., the parts are submerged in acid in a fixture and a stream of liquid acid is forced from a manifold through the space (in the fixture) which has a horizontal orientation. This manifold method created a variety of problems which resulted in poor or incomplete etching. The main defect was called a "teardrop." This is an area of partially-etched material extending below the desired etch line. This defect was reduced in size through process adjustments but produced smaller defects called "snake bites." These are small partially-etched areas located just below the etch line. Several methods were tried to remove these defects. These are summarized as follows:

(1) Flow Variation—The flow rate was increased, decreased, and alternately turned on and off. In each case, these chemical variations showed a poorer result than what had already been achieved. There was a greater percent of defective parts.

(2) Fixture Rotation—It was observed that the defect was generally confined to one side of the fixture. So, during the middle of the etch, the fixture was rotated in the manifold to allow acid to flow from the opposite side. This reduced the defect size but did not eliminate it.

(3) Increased Etching Time—The time of etching was increased with no improvement of defects.

(4) Fixture Orientation—It was thought, because of the fixture design, that bubbles of nitrous oxide and hydrogen were trapped in countersinks in the mask plate. The idea was to turn the fixture over so that the bubbles would rise and escape from the countersink. This had no effect in reducing defects. A second method of orientation was to place the manifold on an angle to again allow trapped bubbles to escape. As with the other methods, there wasn't any improvement in the defects.

Once these variations of the manifold method were tried, it was seen that an alternate etching method was needed. Several methods were tried with better etching results than with the manifold method, but there were still defects. These methods are:

(5) Rotating Dip—Several variations of this method were tested. The basic idea is to suspend the fixture in an acid bath and rotate it to allow fresh acid to get into the slot. Rotating the fixture in a single direction or oscillating the fixture showed a minor improvement, but didn't remove the defects.

(6) Stationary Dip—A flow of acid through the fixture in any form gave a defect, so the method tried was to allow the fixture to remain stationary and not flow acid through it. The fixture was put on an angle to allow gas bubbles to escape, yet the method showed no improvement in the etched product.

(7) Increased Mask Plate Hole Size—The gas bubbles being generated may have been trapped on the countersinks of the mask plate because the cathode was too close to the through hole. It was thought that by increasing the diameter of the hole, it would force larger bubbles to form, and it would be easier to carry them away. It was found that, as the hole size was increased, the defect levels decreased; however, the uniformity of the etched edge of the cap was reduced. So, although defects decreased in number, the quality of the cathodes was reduced.

(8) Limp Stream Etch—This method was arrived at when all of the above-mentioned methods were tested and showed little or no overall improvement. The main objectives which led to the method are the need for:

(a) a less complex machine design and a simpler process, (b) a way to let the generated gas bubbles escape from the fixture, (c) a better, more efficient etching method which produces etched parts with defects, (d) an etching method which required an acid flow from only one direction.

The original concept was to place the fixture under a waterfall. This worked well, yet did not completely eliminate defects. This was because the exchange rate of acid was too great, and the acid was not in contact with the parts long enough to etch at a uniform rate. To solve this problem, the flow pattern was changed to a single solid limp stream issuing from a 6.35-mm (0.25 inch) pipe flowing downwardly, principally by gravity, at about 3 gpm. This worked very well with close to zero defects, with those remaining defects being so small as to be acceptable. It was desired to reduce the flow rate in order to minimize heat loss due to evaporation. The final flow of about 1.0 to 1.5 gpm used a 3.18-mm (0.125 inch) pipe. During testing it was observed that the novel etching method allowed the process reaction to take place faster. It was found that the etching step, which originally took 6 minutes, could be reduced to 4 minutes or less. The limp stream is moved into and out of contact with each of the parts. This can be achieved by moving the stream with respect to each part where one or the other is stationary or both are moving. Alternatively, with intermittent flow, both can be stationary.

The number of contacts could be 2 to 10 times per minute.

What is claimed is:

1. In a method for preparing an integral cathode substrate and support including (a) providing a formed metallic part, said part including a cathode substrate and an integral support therefor, (b) masking selected portions of the surface of said part with an etch-resistant mask, (c) etching the unmasked portions of said surface to a desired depth (d) and then removing said mask, the improvement wherein said etching step is conducted by alternately directing a solid limp stream of liquid etchant into and out of contact with said part while permitting said liquid etchant to drain away from said part by the force of gravity.

2. The method defined in claim 1 wherein said metallic part comprises a bimetal laminate of which one metal thereof is soluble in a particular etchant and the other metal thereof is substantially insoluble in said etchant.

3. The method defined in claim 2 wherein said metallic part comprises a substantially cylindrical bimetal sidewall and a bimetal endwall integral with one end of said sidewall, said endwall comprising said cathode substrate, and wherein said selected masked portions include said endwall and adjacent portions of said sidewall.

4. A method defined in claim 1 wherein said limp stream is directed alternately into and out of contact with said part between 2 and 10 times per minute.

5. The method defined in claim 4 wherein said etching step is conducted for a period of between 2 and 5 minutes.

6. The method defined in claim 5 wherein said etching step is conducted by moving said part and said stream relative to one another.

7. The method defined in claim 6 wherein said etching step is conducted by moving said part into and out of contact with a stationary downwardly-directed stream.

8. The method defined in claim 6 wherein said etching step is conducted by downwardly directing said stream and moving said downwardly-directed stream into and out of contact with a stationary part.

9. The method defined in claim 1 including pressing surface portions of an etch-resistant, compressible sheet against selected surface portions of said part, providing a chamber around said part, said sheet constituting one wall of said chamber, and wherein said etching step is conducted by passing said stream of liquid etchant downwardly through said chamber into contact with unmasked surface portions of said part.

10. The method defined in claim 9 including providing a plurality of said formed metal parts, each part including an endwall and a peripheral sidewall integral with said endwall, mounting each metal part on a mandrel with all of the external surfaces endwalls of parts located in a plane, pressing surface portions of said sheet against all of said endwalls in said plate, and moving said downwardly-directed stream back and forth over the parts in said chamber.

* * * * *